US008287346B2

(12) United States Patent
Miller

(10) Patent No.: US 8,287,346 B2
(45) Date of Patent: Oct. 16, 2012

(54) LATE GAME SERIES INFORMATION CHANGE

(75) Inventor: Mark A. Miller, New York, NY (US)

(73) Assignee: CFPH, LLC, New York, NY (US)

( * ) Notice: Subject to any disclaimer, the term of this patent is extended or adjusted under 35 U.S.C. 154(b) by 902 days.

(21) Appl. No.: 12/263,789

(22) Filed: Nov. 3, 2008

(65) Prior Publication Data

US 2010/0113119 A1 May 6, 2010

(51) Int. Cl.
*A63F 9/24* (2006.01)

(52) U.S. Cl. ..... 463/13

(58) Field of Classification Search ..... 463/13
See application file for complete search history.

(56) References Cited

U.S. PATENT DOCUMENTS

| | | | | |
|---|---|---|---|---|
| 4,266,770 | A | 5/1981 | Yeager | |
| 4,531,187 | A | 7/1985 | Uhland | |
| 4,926,327 | A | 5/1990 | Sidley | |
| 5,255,915 | A | 10/1993 | Miller | |
| 5,356,145 | A | 10/1994 | Verschoor | |
| 5,586,766 | A | 12/1996 | Forte et al. | |
| 5,605,334 | A | 2/1997 | McCrea, Jr. | |
| 5,630,753 | A * | 5/1997 | Fuchs | 463/9 |
| 5,707,287 | A | 1/1998 | McCrea, Jr. | |
| 5,803,808 | A | 9/1998 | Strisower | |
| 5,836,586 | A | 11/1998 | Marks et al. | |
| 5,851,147 | A | 12/1998 | Stupak et al. | |
| 5,941,769 | A | 8/1999 | Order | |
| 5,967,894 | A * | 10/1999 | Kinoshita et al. | 463/13 |
| 6,126,541 | A * | 10/2000 | Fuchs | 463/13 |
| 6,139,014 | A | 10/2000 | Breeding et al. | |
| 6,217,447 | B1 | 4/2001 | Lofink et al. | |
| 6,386,973 | B1 | 5/2002 | Yoseloff | |
| 6,585,591 | B1 * | 7/2003 | Baerlocher et al. | 463/25 |
| 6,612,926 | B1 | 9/2003 | Dabrowski | |
| 6,663,487 | B1 | 12/2003 | Ladner | |
| 6,811,486 | B1 * | 11/2004 | Luciano, Jr. | 463/24 |
| 6,869,074 | B2 | 3/2005 | Miller | |
| 7,056,205 | B2 * | 6/2006 | Odom et al. | 463/13 |
| 7,086,943 | B2 | 8/2006 | Mugnolo et al. | |
| 7,114,718 | B2 | 10/2006 | Grauzer et al. | |

(Continued)

FOREIGN PATENT DOCUMENTS

JP 10-507103 7/1998

(Continued)

OTHER PUBLICATIONS

U.S. Appl. No. 11/850,565, filed Sep. 5, 2007, Lutnick et al.

(Continued)

*Primary Examiner* — Peter DungBa Vo
*Assistant Examiner* — Nicholas Ditoro

(57) ABSTRACT

A method and/or device is set forth for playing a game. In some embodiments, an inventory of data representing playing cards is arranged in a random but established, serial order. In some embodiments, for each hand of play the player makes a wager and cards are displayed, according to the rules of the game, in order from the inventory to define a winning or losing outcome. In some embodiments, a display, as hands are played, displays the remaining constituency of the inventory and the player, before any hand, can order re-shuffling and re-constitute of the inventory. In some embodiments, re-shuffling may be triggered by a card or hand count or certain pre-defined triggers. Other embodiments are described.

28 Claims, 5 Drawing Sheets

U.S. PATENT DOCUMENTS

| | | | | |
|---|---|---|---|---|
| 7,182,690 | B2 * | 2/2007 | Giobbi et al. | 463/24 |
| 7,341,519 | B2 | 3/2008 | McMain et al. | |
| 7,419,162 | B2 | 9/2008 | Lancaster et al. | |
| 7,425,178 | B1 | 9/2008 | Odom | |
| 7,431,648 | B2 * | 10/2008 | Odom et al. | 463/21 |
| 7,523,941 | B2 * | 4/2009 | Thomas et al. | 273/274 |
| 7,530,572 | B2 * | 5/2009 | Thomas et al. | 273/274 |
| 7,611,409 | B2 * | 11/2009 | Muir et al. | 463/29 |
| 7,717,429 | B2 * | 5/2010 | Lutnick et al. | 273/292 |
| 7,811,167 | B2 * | 10/2010 | Giobbi et al. | 463/24 |
| 7,914,369 | B2 | 3/2011 | Walker et al. | |
| 7,942,418 | B2 * | 5/2011 | Amaitis et al. | 273/292 |
| 8,079,595 | B2 | 12/2011 | Lutnick et al. | |
| 8,137,173 | B2 | 3/2012 | Miller | |
| 8,147,307 | B2 | 4/2012 | Miller | |
| 8,147,308 | B2 | 4/2012 | Miller | |
| 8,192,266 | B2 | 6/2012 | Alderucci et al. | |
| 2001/0035608 | A1 | 11/2001 | Hoyt et al. | |
| 2002/0068635 | A1 | 6/2002 | Hill | |
| 2002/0103017 | A1 | 8/2002 | Odom et al. | |
| 2002/0155872 | A1 * | 10/2002 | Odom et al. | 463/13 |
| 2002/0195773 | A1 | 12/2002 | Dunn | |
| 2003/0109310 | A1 | 6/2003 | Heaton et al. | |
| 2004/0082373 | A1 * | 4/2004 | Cole et al. | 463/13 |
| 2004/0142742 | A1 * | 7/2004 | Schneider et al. | 463/25 |
| 2005/0037834 | A1 * | 2/2005 | Stern et al. | 463/20 |
| 2005/0130728 | A1 | 6/2005 | Nguyen et al. | |
| 2005/0143158 | A1 | 6/2005 | Odom et al. | |
| 2005/0161882 | A1 | 7/2005 | Miller | |
| 2005/0181851 | A1 | 8/2005 | Amaitis et al. | |
| 2006/0079308 | A1 | 4/2006 | Asher et al. | |
| 2006/0121978 | A1 | 6/2006 | Hornik et al. | |
| 2006/0183540 | A1 | 8/2006 | Grauzer et al. | |
| 2006/0189382 | A1 | 8/2006 | Muir et al. | |
| 2007/0054721 | A1 | 3/2007 | Jackson | |
| 2008/0054568 | A1 | 3/2008 | Lutnick et al. | |
| 2008/0067743 | A1 | 3/2008 | Naicker | |
| 2008/0090650 | A1 * | 4/2008 | Tarantino | 463/25 |
| 2008/0119257 | A1 * | 5/2008 | Stern et al. | 463/13 |
| 2008/0182644 | A1 | 7/2008 | Lutnick et al. | |
| 2010/0009737 | A1 | 1/2010 | Lutnick et al. | |
| 2010/0099477 | A1 | 4/2010 | Alderucci et al. | |
| 2010/0099478 | A1 | 4/2010 | Alderucci et al. | |
| 2010/0099479 | A1 * | 4/2010 | Miller | 463/12 |
| 2010/0099481 | A1 | 4/2010 | Alderucci et al. | |
| 2010/0105457 | A1 | 4/2010 | Miller | |
| 2010/0105458 | A1 | 4/2010 | Miller | |
| 2010/0105459 | A1 | 4/2010 | Miller | |
| 2010/0105461 | A1 * | 4/2010 | Miller | 463/16 |
| 2010/0105465 | A1 | 4/2010 | Miller | |
| 2010/0113126 | A1 | 5/2010 | Miller | |
| 2010/0113137 | A1 | 5/2010 | Miller | |
| 2010/0120483 | A1 | 5/2010 | Lutnick et al. | |
| 2011/0180993 | A1 | 7/2011 | Amaitis et al. | |
| 2012/0056374 | A1 | 3/2012 | Lutnick et al. | |
| 2012/0058814 | A1 | 3/2012 | Lutnick et al. | |

FOREIGN PATENT DOCUMENTS

| | | |
|---|---|---|
| WO | WO/96/04970 | 2/1996 |

OTHER PUBLICATIONS

U.S. Appl. No. 11/669,996, filed Feb. 1, 2007, Lutnick et al.
U.S. Appl. No. 11/972,002, filed Jan. 10, 2008, Amaitis et al.
U.S. Appl. No. 12/169,383, filed Jul. 8, 2008, Lutnick et al.
U.S. Appl. No. 12/252,488, filed Oct. 16, 2008, Alderucci et al.
U.S. Appl. No. 12/253,343, filed Oct. 17, 2008, Alderucci et al.
U.S. Appl. No. 12/254,485, filed Oct. 20, 2008, Alderucci et al.
U.S. Appl. No. 12/255,123, filed Oct. 21, 2008, Miller.
U.S. Appl. No. 12/256,634, filed Oct. 23, 2008, Miller.
U.S. Appl. No. 12/256,640, filed Oct. 23, 2008, Miller.
U.S. Appl. No. 12/257,649, filed Oct. 24, 2008, Miller.
U.S. Appl. No. 12/259,325, filed Oct. 28, 2008, Miller.
U.S. Appl. No. 12/259,330, filed Oct. 28, 2008, Miller.
U.S. Appl. No. 12/263,768, filed Nov. 3, 2008, Miller.
U.S. Appl. No. 12/263,779, filed Nov. 3, 2008, Miller.
USPTO Office Action for U.S. Appl. No. 12/688,422, dated Nov. 15, 2010 (7 pages).
USPTO Office Action for U.S. Appl. No. 11/972,002, dated Oct. 20, 2010 (6 pages).
U.S. Appl. No. 60/824,522, filed Sep. 5, 2006, Lutnick et al.
U.S. Appl. No. 60/824,648, filed Sep. 6, 2006, Lutnick et al.
USPTO Notice of Allowance and Fees Due for U.S. Appl. No. 11/972,002, dated Feb. 4, 2011 (7 pages).
USPTO Office Action for U.S. Appl. No. 12/169,383, dated Mar. 28, 2011 (11 pages).
Japanese Office Action with English Translation for Application No. 2009-518656, mailed Mar. 15, 2011 (6 pages).
USPTO Office Action for U.S. Appl. No. 12/252,488, dated Mar. 31, 2011 (7 pages).
USPTO Office Action for U.S. Appl. No. 12/255,123, dated Apr. 20, 2011 (6 pages).
USPTO Office Action for U.S. Appl. No. 12/256,634, dated Apr. 6, 2011 (8 pages).
USPTO Office Action for U.S. Appl. No. 12/259,325, dated Apr. 13, 2011 (8 pages).
USPTO Office Action for U.S. Appl. No. 12/263,768, dated Apr. 25, 2011 (6 pages).
Australian Examiner's Report for Australian Application No. 2007292385, dated May 26, 2011 (3 pages).
USPTO Office Action for U.S. Appl. No. 11/850,565, dated May 12, 2011 (7 pages).
U.S. Appl. No. 12/688,422, filed Jan. 15, 2010, Lutnick et al.
Canadian Examiner's Report for Application No. 2,625,171 dated Oct. 7, 2009 (4 pages).
Notification of Transmittal of the International Search Report and Written Opinion for International Application No. PCT/US07/77646, dated Sep. 30, 2008 (11 pages).
International Preliminary Report on Patentability for International Application No. PCT/US07/77646, dated Mar. 10, 2009 (6 pages).
USPTO Office Action for U.S. Appl. No. 11/669,996; dated Feb. 17, 2009 (11 pages).
USPTO Examiner Interview Summary for U.S. Appl. No. 11/669,996; dated Jun. 17, 2009 (4 pages).
Olaf Vancura & Ken Fuchs, Knock-Out Blackjack, Sep. 1998, Huntington Press, 1st Edition, pp. 43-72.
Notification of Transmittal of the International Search Report and Written Opinion for International Application No. PCT/US08/52461, dated Jul. 8, 2008 (10 pages).
International Preliminary Report on Patentability for International Application No. PCT/US08/52461, dated Aug. 4, 2009 (6 pages).
Australian Examiner's Report for Australian Application No. 2008201369, dated Aug. 26, 2009 (2 pages).
Australian Examiner's Report for Australian Application No. 2007292385, dated May 28, 2010 (2 pages).
USPTO Examiner Interview Summary for U.S. Appl. No. 11/669,996; dated Nov. 23, 2009 (2 pages).
USPTO Notice of Allowance and Fees Due for U.S. Appl. No. 11/669,996; dated Nov. 23, 2009 (8 pages).
USPTO Office Action for U.S. Appl. No. 11/972,002, Mar. 19, 2010 (6 pages).
USPTO Supplemental Notice of Allowability for U.S. Appl. No. 11/669,996, Apr. 6, 2010 (4 pages).
USPTO Office Action for U.S. Appl. No. 11/972,002, Jun. 3, 2010 (8 pages).
"Baccarat—Learn to play like a professional with a unique free evaluation—Save Money", 4 pages; Accessed Oct. 13, 2008; http://web.archive.org/web/20010603045041/www.happyfortune.com/features.htm.
"Casino Verite Blackjack History", 8 pages; Accessed Oct. 13, 2008; http://web.archive.org/web/20010819115538/www.qfit.com/cvhist.htm.
Blackjack Table Image, 1 page; Accessed Oct. 13, 2008; http://web.archive.org/web/20010414005535/www.qfit.com/cvssb1.htm.
"Counting Cards", 1 page; Accessed Oct. 13, 2008; http://web.archive.org/web/20010715031334/www.casinosoftware.net/software/html/CC2Setup.zip.html.

"Deck of Cards.Java Programming Assignment"; 4 pages; Accessed Oct. 13, 2008 http://web.archive.org/web/20010418172543/www.cs.clemson.edu/~pargas/courses/cs241/current/assignments/spring2001/p1/DeckOfCards.html.
"Baccarat—Learn to play like a professional with a unique free evaluation—FEATURES", 4 pages; Accessed Oct. 13, 2008 http://web.archive.org/web/20010603045041/www.happyfortune.com/features.htm.
USPTO Office Action for U.S. Appl. No. 12/252,488, dated Nov. 2, 2011 (4 pages).
USPTO Notice of Allowance and Fees Due for U.S. Appl. No. 12/256,634, dated Nov. 7, 2011 (5 pages).
USPTO Office Action for U.S. Appl. No. 12/259,325, dated Nov. 21, 2011 (6 pages).
USPTO Notice of Allowance and Fees Due and Examiner Interview Summary Record for U.S. Appl. No. 12/688,422, dated Aug. 12, 2011 (11 pages).
USPTO Office Action for U.S. Appl. No. 12/254,485, dated Oct. 7, 2011 (12 pages).
USPTO Office Action for U.S. Appl. No. 12/256,640, dated Sep. 19, 2011 (26 pages).
USPTO Office Action for U.S. Appl. No. 12/257,649, dated Jun. 24, 2011 (6 pages).
USPTO Office Action for U.S. Appl. No. 12/259,330, dated Oct. 4, 2011 (25 pages).
USPTO Office Action for U.S. Appl. No. 12/263,779, dated Jul. 22, 2011 (15 pages).
Canadian Examiner's Report for Application No. 2,662,856, dated Aug. 19, 2011 (3 pages).
USPTO Office Action for U.S. Appl. No. 12/253,343, dated Oct. 12, 2011 (11 pages).
Australian Notice of Acceptance for Application No. 2007292385, dated Feb. 29, 2012 (3 pages).

* cited by examiner

LATE GAME SERIES INFORMATION CHANGE

DESCRIPTION

Figure 1:
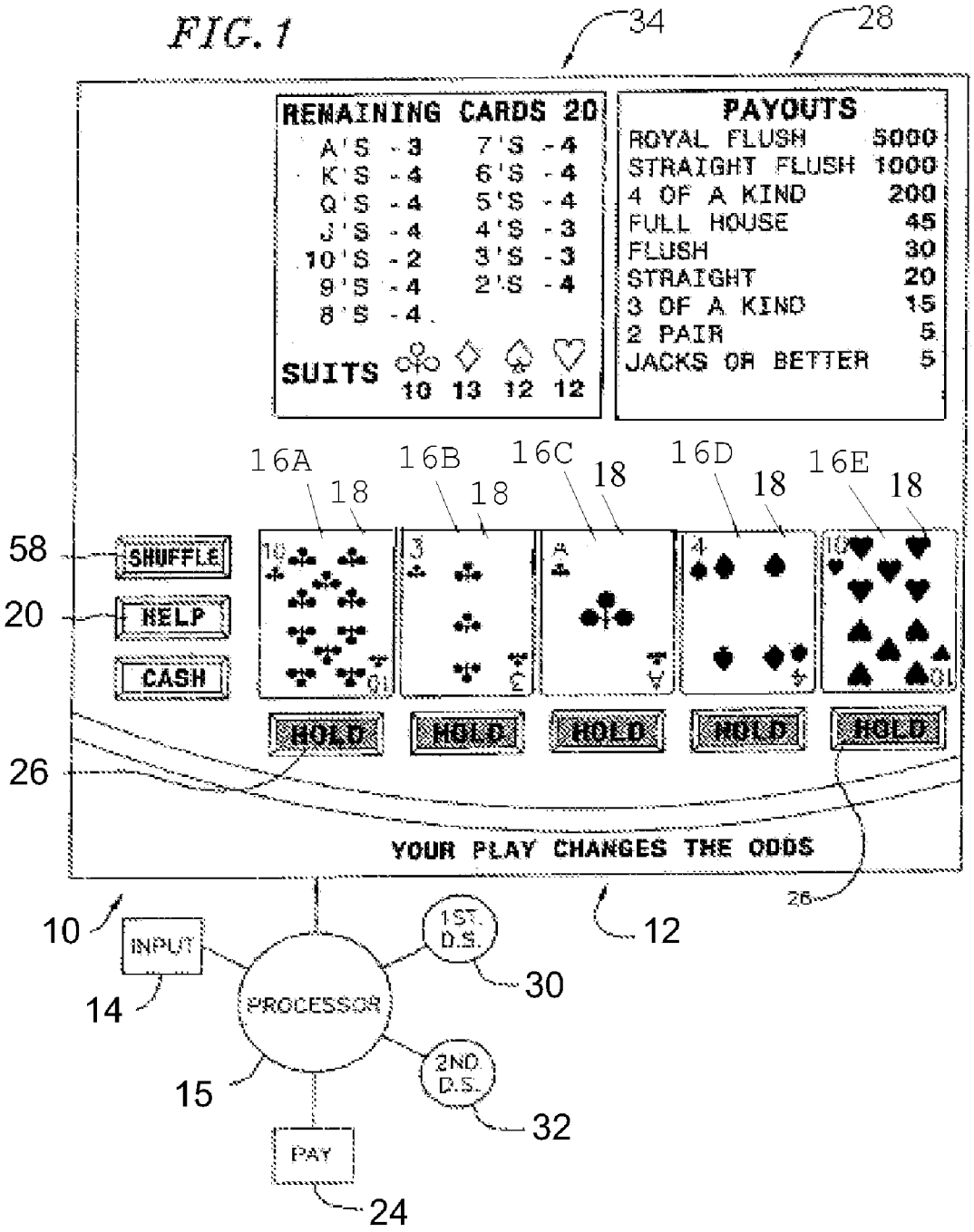
FIG. 1 shows a processor controlled display after the play of one hand of Video Poker.

U.S. patent application Ser. No. 09/977,138 entitled "Electronic Card Game and Method," filed Oct. 12, 2001, U.S. Provisional Application Ser. No. 60/241,644 entitled "Electronic Video Poker Game and Method," filed Oct. 19, 2000, U.S. patent application Ser. No. 09/942,520 entitled "Live And Electronic Wagering And Lottery Game," filed Aug. 29, 2001, U.S. Provisional Application Ser. No. 60/229,665 entitled "Live and Electronic Wagering and Lottery Game," filed Aug. 31, 2000, and U.S. patent application Ser. No. 11/007,108, entitled "Method of conducting a wagering game with continuous depletion," filed Dec. 7, 2004 are all hereby incorporated herein by reference.

Some embodiments of the present invention relate to methods and devices for playing electronic video Poker, Blackjack and other card games.

Video Poker is a well known game that may be played using an electronic device such as a computer with a display, a hand-held device or with a dedicated, video Poker gaming machine. In some embodiments, the play of basic video Poker is the same whether it is played with a hand held, electronic novelty device, with a computer, through the Internet or with a dedicated gaming machine. Some of the following description is primarily directed to a dedicated, video Poker gaming or video lottery machine of the type found in casinos.

To play the game according to some embodiments, the player makes a wager by any suitable means such as by wagering credits, inserting tokens or the like. In some implementations, once the wager is made the machine is prompted for play whereupon the processor for machine randomly selects from data representing a deck of playing cards, data representing ten playing cards. In some implementations, this data may not be arranged in any order and typically is configured as a data string representing the cards of the deck in no particular order. In some implementations, this order is fixed when the data string is constructed; however the random selection from the string in some implementations makes the fixed order, at least to a degree, irrelevant. In some implementations, from this randomly selected data, five playing cards are displayed representing the initial holding and the data for the remaining ten cards is held in inventory. In some implementations, the player, using a touch screen on the game display or buttons on the machine, selects which cards to discard, if any, from the initial holding. In some implementations, the data representing the discarded cards is replaced with the inventoried data and the replacement cards are displayed. In some implementations, the final hand is (with or without replacement cards) is compared to a schedule of winning hands based on the ranking of hands of Poker. If the player has a winning final hand, they are paid based upon their wager. If they do not have a winning hand, their wager is lost. In some implementations, after determination of the outcome of the hand, the player makes another wager and plays the next hand according to the above.

In some embodiments, for each new hand of play, the initial hand is selected from data representing a full deck of cards. This deck may have the standard fifty-two cards or may include an additional, wild, Joker. In this regard, it is further known to provide games according to the above based upon a deuces wild, Joker's wild and Joker's and deuces wild format. In some implementations, the play of a hand does not deplete the deck data stored for the next hand. In some implementations, the device does not track nor display cards remaining in the deck since there is no deck depletion as hands are played. In some implementations, there is no means for the player to select to "reshuffle" or not reshuffle after a series of hand.

Video Blackjack is also a known game. According to this game, the player makes a wager and data representing a two card player hand and two card dealer hand are randomly selected and displayed from a full deck of fifty-two cards. The cards of the player hand are revealed whereas only one card of the dealer hand is shown. The player, using an input device, opts to stand, split, double down and take one or more hits to complete his hand according to the rules of the game. The dealer's hand is then revealed and completed. As between the dealer and player, the one having a hand count at or closest to "21" wins the hand. In some implementations, after the hands are completed and compared and any wager paid or collected, a new wager is made and cards are dealt from a fully constituted deck.

In some embodiments, for the table game version of Blackjack, a series of hands are dealt from a deck and the deck is depleted to a point where the deck is re-shuffled.

Baccarat is another known game where, in some implementations, a deck of cards is shuffled to configure the cards into a random, serial order and where multiple hands are dealt from the deck before a point is reached in penetration through the deck where the deck is re-shuffled.

Further, in regards to deck depletion through a series of hands for the play of games of the type described, the same does not occur with respect to some implementations of electronic card games since the deck is fully constituted at the start of each hand. Further, where a deck is depleted over a series of hands, some implementations may include displaying to players the remaining constituency of the depleted deck so they can see the cards available for play. In most jurisdictions, card counting, e.g. a player determining the remaining cards in the deck based upon the cards played (in Blackjack where multiple rounds of hands are played from a deck of cards) is a crime or a basis for ejecting the player from the casino.

In some embodiments, at least for a plurality of hands of play, the cards which have been played deplete the deck for the succeeding hand. In some embodiments, a processor tracks the cards which have been played and therefore can determine and display, if desired, the inventory of cards remaining in the deck for play of the next hand. Some embodiments include a game where the player can order "reshuffling" if he/she desires. Some embodiments include a game of the type described above where re-shuffling of the deck data, if not ordered by the player, is required based upon one or more pre-selected triggers.

Some embodiments include a method and/or electronic device for playing a card game such as a Video Poker game where the deck(s) are randomized (shuffled) into a random, serial order 1-N, where cards for play are selected and displayed in serial order for the deck, where the constituency of the deck. i.e. the remaining cards available for play, are displayed and where the deck is reconstituted and reconfigured into a new, random, serially arranged deck of N cards based upon the count of displayed cards, a command prompt by the player or a pre-determined trigger and where the displayed pay table may be reconfigured to reflect the fact that, based upon depletion of the deck, certain winning outcomes cannot obtained.

Some embodiments include a method and/or device for playing a card game such as a Video Poker game which includes providing a data processor including a first data structure storing data representing at least one deck of N playing cards according to the rules of the game. For example, for some implementations of regular Poker, the first data structure would store data representing each card of a fifty-two card deck. In the first data structure the card data is configured a random, serial order representing a deck of shuffled cards. The player makes a wager and plays a series of hands. For each hand of play, data is selected from the first data structure and displaying at an electronic display data representing an initial holding of at least three playing cards, e.g. a five card Poker hand, the data selected in order from the serially arranged deck data. The player opts to discard one or more of said displayed playing cards of the initial holding, the processor for any discarded card selecting and displaying a replacement card selected in order for the serially arranged deck data to define a final outcome, five card, combination. The final card combination is compared to data stored in a second data structure storing data representing winning outcomes. If the player has obtained a winning outcome an award corresponding to a winning outcome is issued to the player. It should be recognized that this example is non-limiting and that other embodiments may not involve serial orders, such data structures, and/or may include any other elements or methods.

In some embodiments, a processor maintains data representing the constituency of the deck data remaining in the first data structure, e.g. how many Aces-Deuces are left, and displays the constituency of the deck data depleted of said displayed cards. Thus, in some implementations, as cards are selected from the serially arranged deck and before the next hand of play, there is displayed for the player the remaining constituency of the deck which the player may use to guide their decisions as to which cards to discard. It should be recognized that other embodiments may not include such elements or actions and/or may include alternatives.

In some embodiments, the feature of displaying the remaining constituency of the deck through the play of a series of hands may also be incorporated into video versions of Blackjack, Baccarat and other games.

In some embodiments, at a predetermined count of selected cards, the deck data is reconstituted and reconfigured such that the cards are randomly positioned in a serially ordered deck representing a re-shuffled deck. In some embodiments, as new hands are played cards are selected in series form the deck data so as to correspond to dealing of cards from the top of the deck. In some embodiments, reconstitution and reconfiguration may also be triggered, as by the play of the Joker in Joker's Wild Poker or upon prompting by the player.

Figure 2:
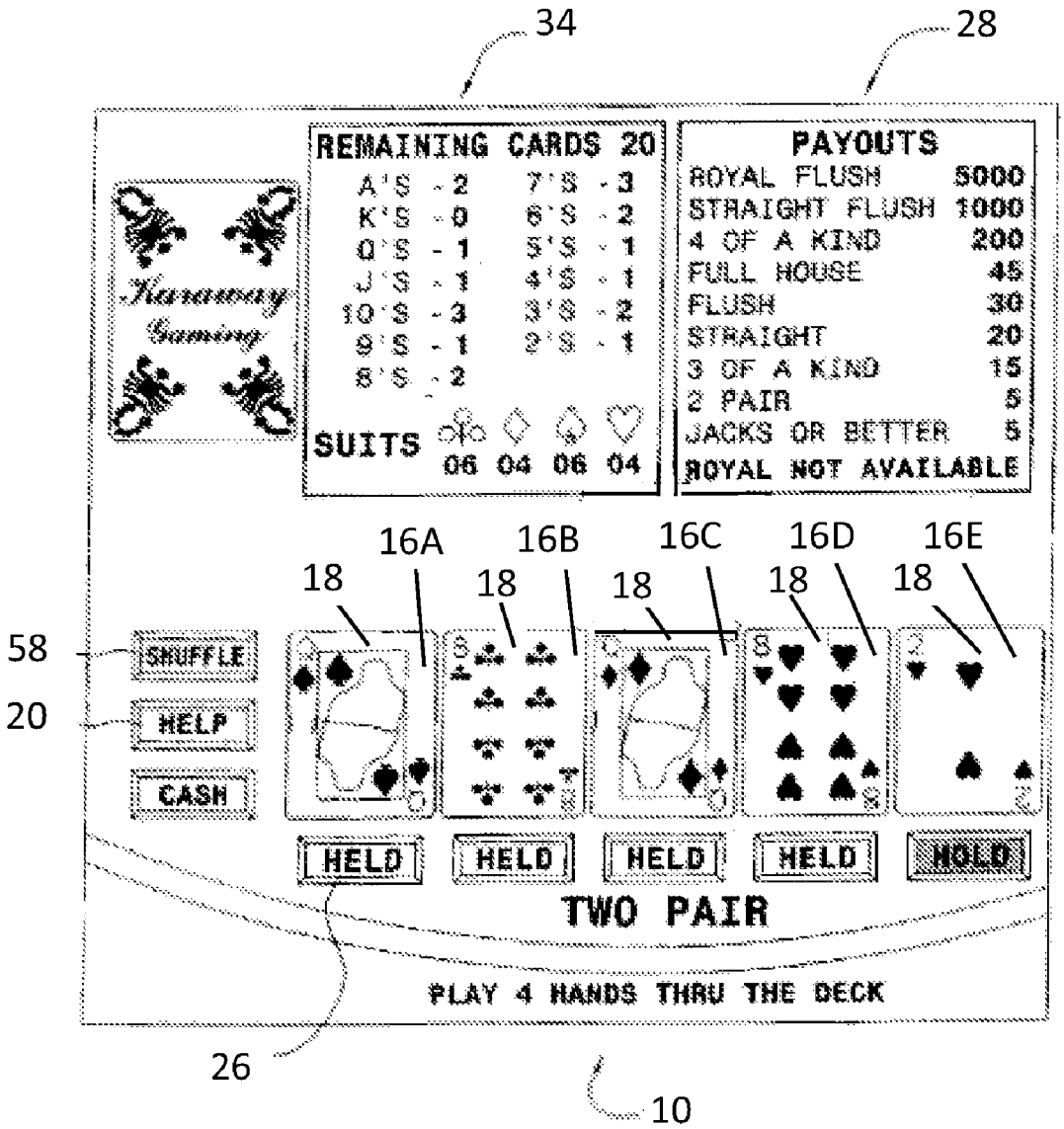
FIG. 2 shows the processor controlled display after the play of another hand of play of Video Poker.

Turning to the drawings, FIGS. 1 and 2 show an electronic display 10 for the game and method according to some embodiments of the present invention. The display 10 may be presented by a video display or plasma display for a gaming machine or on a computer monitor or handheld game display.

With reference to FIG. 1, a device 10 and method for a Video Poker embodiment of the present invention is shown. In some embodiments, the device 10 includes an electronic video display 12 presenting an example of the layout for the play of the game. The device 10 may be incorporated into any platform such as those currently known in the art. For example, the display 12 may be a touch screen display including data input means 14 to control the game/machine processor 15; however it should be understood that other data input means could be used such as machine buttons, mouse, keyboard or the like.

In some embodiments, the display 12 has a locations 16*a* e for the display of the game hand cards 18 during play. During the play of the device 10 and method, cards 18 are displayed in a manner as hereinafter described to play the game method in some embodiments.

Not shown in FIGS. 1 and 2, the device 10 and/or display 12 may include a credit meter, as is known on the art, to keep a tally on the gaming credits available for play and means for the player to input a wager and prompt play of the game. For example, the device may include a cash reader or token acceptor by which the player may input the desired wager as well as input means to wager accumulated credits, again as is known in the art.

To provide information to the player, the display 12 may include a touch screen help button 20 which, if touched by the player, prompts the processor 15 to display helpful information to the player. Also included in some embodiments is a cash out button 22 which if touched by the player prompts the processor 15 to operate a pay device 24 which may be a coin hopper device, voucher writer, credit or debit card writer or a program to transfer accumulated credits to the player's established account.

In some embodiments, to enable the player to hold/discard cards 18, each location 16*a e* has associated therewith a hold button 26. In some embodiments, as is known in the play of Video Poker, if the player desires to hold a card 18, he/she touches the corresponding hold button 26 which prompts the processor 15 for the game to retain the display of the held card 18. Cards which are not held in the initial hand or holding, are replaced with replacement cards to define the final, outcome, holding. The final holding, as described below, is compared to an established pay table to determine if the player has a winning or losing outcome.

In some embodiments, the processor 15 controls the display 12 to also display a pay table which lists winning outcomes and the pay for each. Data corresponding to winning combinations and the pay or award for each may be stored in a second data structure 32

In some embodiments, data representing the deck of N cards for play of the game is stored in a first data structure 30, such as a digital memory device. Where the deck is a single, standard deck, N=52 cards. The data may be stored in a serial order, each address representing a playing card of the deck. In some embodiments, the data is stored in a fashion to replicate a shuffled deck of playing cards. For example, when newly shuffled for play, the card data is stored in the first data structure 30 as a sequential string of card data representing cards N.sub.1 N.sub.52. In this example, the cards in the addresses N.sub.1 N.sub.52 are not in any suit or value order but instead are randomized simulating a shuffled deck of cards, with the top card being N.sub.1 and the bottom card being N.sub.52. In some embodiments, a random number generator may be used to randomly select cards for each address. Thus, to the processor 15 and first data structure 30, the data is arranged in a fashion similar to that of a shuffled deck of cards in some embodiments. It should be recognized, that these examples are non-limiting, and as discussed below, other embodiments may include other elements and/or methods.

In some embodiments, when the play of the game is prompted after shuffling (reconstitution and reconfiguration of the data), the processor 15 selects the first five addresses N.sub.1 N.sub.5 in the data structure defining the initial holding and, with that data, displays the corresponding cards at the display in locations 16*a* e as shown in FIG. 1. In some embodiments, the next card selected would be N.sub.6. In some embodiments, if, on the other hand, the last card displayed form the previous game was at address position N.sub.20, the processor would access address positions N.sub.21 N.sub.25 and display the cards corresponding to those addresses. Of course other arrangements of data may be used to simulate the ordered, serial and random arrangement of cards in a shuffled deck. It should be recognized that these examples are not limiting and that other embodiments may include other methods or elements.

In some embodiments, the processor 15 controls the display 12 to display a table 34 which describe the inventory data representing cards of the first data structure 30. Table 34 is updated as card data is selected and cards displayed to impart information as to the remaining constituency of the data, i.e. how many of each card are left in the inventory.

Figure 3:
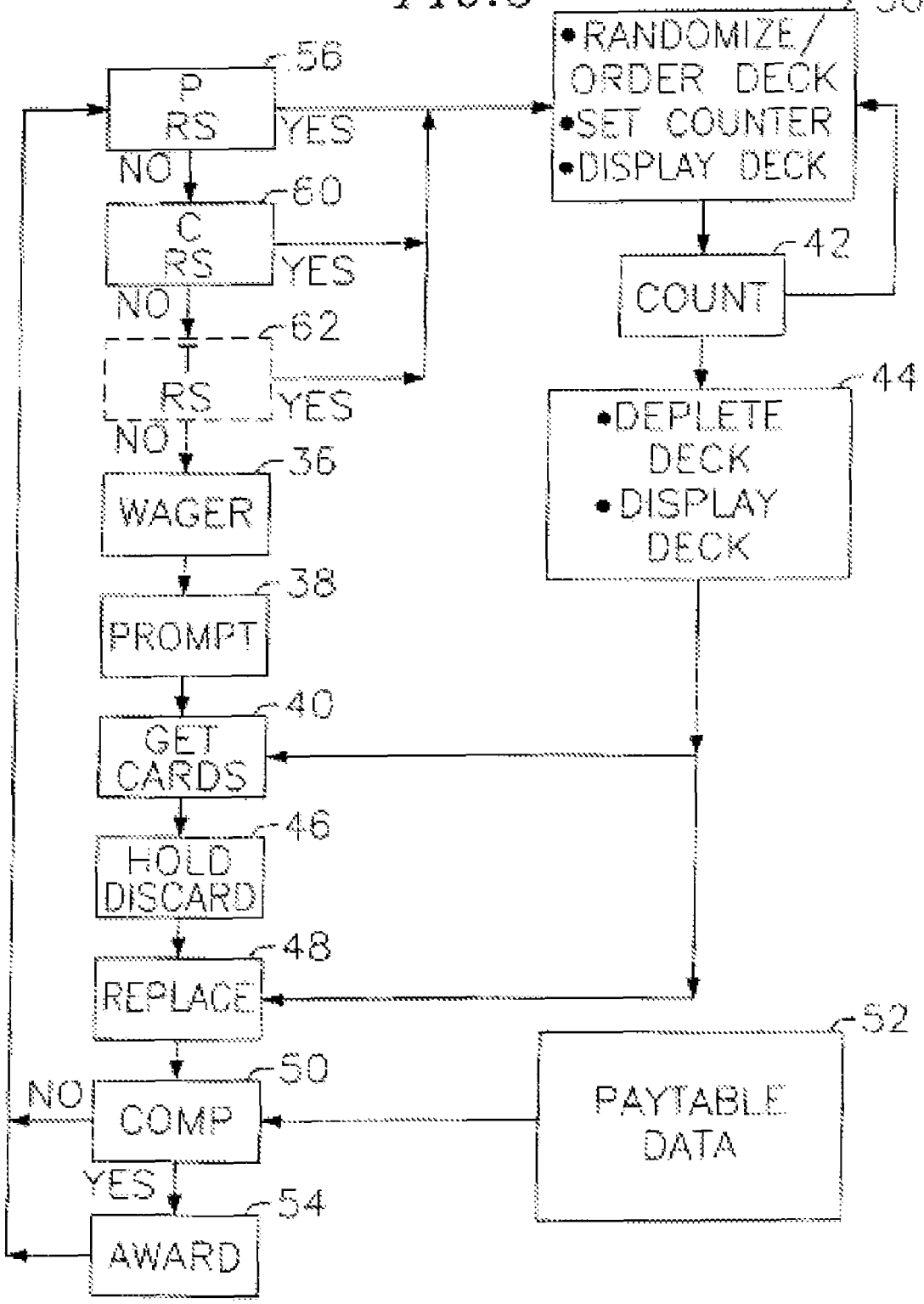
FIG. 3 illustrates a flowchart for a game of Video Poker.

With reference to FIGS. 1 and 3, a method of the play and the device 10 for Video Poker will now be described.

Video Poker

In this example, at 36 the player inputs their desired wager to play a hand of Video Poker and at 38 prompts the processor 15 for play. In this example, the processor 15 accesses the first data structure 30 to get the next cards 18 at 40 in order from the random, serially arranged, deck data. For purposes of discussion and with reference to FIG. 1, it is assumed that the deck data of the first data structure 30 has been re-randomized, reconstituted and serially ordered into data representing a complete shuffled deck of fifty-two cards N.sub.1 N.sub.52. Thus, at 40, the processor 15 gets cards N.sub.1 N.sub.5 and displays the same at the display 12 as an initial five card holding of, according to this example, 103A410 (FIG. 1). It should be recognized that this is given as an example only.

With continuing reference to the example of FIG. 3, the processor 15 also counts the number of cards which the current hand has depleted from the deck at 42 as well as accounts for the value, and if desired suit, of the cards remaining in the deck data inventory of the first data structure 30. Thus, if the deck data was a full deck of fifty-two cards of a standard deck of playing cards, the deck by the retrieval and display of five playing cards has been (1) depleted of five cards and (2) specifically depleted of cards 103A410. The processor retabulates the table 34 to account for the depletion of the deck. That is, before and after the display of the cards of the initial holding the table 34 would be altered as suggested below and as reflected in FIG. 1:

TABLE US-00001

| Table Before Initial Deal | | Table After Initial Deal | |
|---|---|---|---|
| A`s | 4 | **A`s** | 3 |
| K`s | 4 | K`s | 4 |
| Q`s | 4 | Q`s | 4 |
| J`s | 4 | J`s | 4 |
| 10`s | 4 | **10`s** | 2 |
| 9`s | 4 | 9`s | 4 |
| 8`s | 4 | 8`s | 4 |
| 7`s | 4 | 7`s | 4 |
| 6`s | 4 | 6`s | 4 |
| 5`s | 4 | 5`s | 4 |
| 4`s | 4 | **4`s** | 3 |
| 3`s | 4 | **3`s** | 3 |
| 2`s | 4 | 2`s | 4 |
| | 52 | | 47 |

(Bold cards reflect deck constituency change)

Thus, in this non-limiting example, at 44 the processor depletes the deck data of the first data structure 30 and displays the remaining constituency of the card data so the player knows which cards remain available for selection and display.

With reference to the example of FIG. 3, at 46 the player selects with the input means 14 which cards of the initial holding to hold. For example, with reference to FIG. 1 the player may decide to hold the 10's. Thus the display 12 would display the cards 18 in the following manner:

TABLE US-00002

| | | | | |
|---|---|---|---|---|
| 10, Hold | 3, | A, | 4, | 10, Hold |

In this example, upon the player prompting play, at 48 the processor 15 selects from the data stored in the first data structure the next data, e.g. N.sub.6 N.sub.8 and displays the same as replacements for the discarded cards 3A4. For example, the hand, after replacements may result in a final holding outcome of:

TABLE US-00003

| | | | | |
|---|---|---|---|---|
| 10, Hold | 10, | J, | J, | 10 Hold |

This holding is a Full House.

In this example, in connection with the retrieval of the replacement card data, the processor at 44 depletes the deck data of the data representing the replacement cards (cards 10.diamond., JJ) and displays at the display 12 at table 34 the new constituency of the deck depleted by the replacement card data. Thus the table 34 would be:

TABLE US-00004

| Table After Initial Deal | | Table After Replacements | |
|---|---|---|---|
| A's | 3 | A's | 3 |
| K's | 4 | K's | 4 |
| Q's | 4 | Q's | 4 |
| J's | 4 | **J's** | 2 |
| 10's | 2 | **10's** | 1 |
| 9's | 4 | 9's | 4 |
| 8's | 4 | 8's | 4 |
| 7's | 4 | 7's | 4 |
| 6's | 4 | 6's | 4 |
| 5's | 4 | 5's | 4 |
| 4's | 3 | 4's | 3 |
| 3's | 3 | 3's | 3 |
| 2's | 4 | 2's | 4 |
| | 47 | | 44 |

(Bold cards reflect deck constituency change)

Thus the player has updated information as to the constituency of the remaining deck data.

In this example, at 50 the processor 15 compares the outcome to data stored in a second data structure 52 representing winning outcomes and the award for each (referred to herein as pay table data) to determine if the player is entitled to an award. If the player has obtained a winning outcome, at 54 the processor 15 issues the appropriate award. Typical pay table data for a five unit wager is as shown at the pay table 28 of FIG. 1. The pays may be linear based upon the tokens wagered or may include one or more higher pays to encourage a maximum coin wager.

In some embodiments, after the award or if no award was won, the processor 15 determines at 56 if the player has prompted re-shuffling of the deck data of the first data structure 30. In some embodiments, the player may prompt reconfiguration and reconstitution of the deck data of the first data structure into data representing a shuffled, random, serially ordered full deck by touching shuffle button 58 (FIG. 1). In some embodiments, the processor 15 reconfigures and reconstitutes the deck data of the first data structure 30 into data representing cards N.sub.1 N.sub.52. In some embodiments, the display 12 would also be controlled to show the constitution of the deck data at table 34. In some embodiments, the player may command re-shuffling where the deck constitution, for the next hand of play, is not what the player desires, e.g. is completely depleted of Aces thus making a Royal Flush impossible for the next hand. It should be noted that where deck depletion makes certain outcomes impossible for the next hand, the processor 15 would re-configure the pay table 28 and remove that outcome in some embodiments. For example, if all Kings are depleted from the deck making a Royal Flush impossible, the Royal Flush pay would be removed from the pay table 28.

In some embodiments, if the player does not command re-shuffling, re-shuffling may be commanded based upon the count of the card data which has been displayed. According to some embodiments, where penetration into the deck data reaches a predetermine number, the processor 15 commands reconfiguration and reconstitution of the deck data. For example, if the count exceeds 30 cards, e.g. (N.sub.1 N.sub.31), at 60 the deck data is reshuffled before the play of the next hand in some embodiments.

In some embodiments, one or more triggers at 62 may trigger re-shuffling and reconstitution of the deck. For example, where the game is a Joker's Wild version of Video Poker, the display of the Joker in the hand may trigger re-shuffling before the play of the next hand. Other triggers may be depletion of one of A's 10's from the deck (making a Royal Flush impossible) or depletion of all the 2's in a Deuces Wild format game.

In some embodiments where re-shuffling takes place, the table 34 may reflect the re-constitution of the deck.

Table 34 may also display the cards remaining for each suit as shown in the example of FIG. 1.

In some embodiments, whether re-shuffling takes place or not, the player at 36 inputs another wager to play the next hand having the information imparted by the table 34 of the constitution of the deck data.

The example of FIG. 2 illustrates the display 12 after completion of a hand which has depleted the deck data to have a remaining set of 32 cards. Since the next hand could require the selection and display of ten cards (initial holding of five cards where all are discarded and replaced) thereby exceeding a forty card deck penetration, re-shuffling of the deck data would occur prior to the play of the next hand in some examples.

As suggested above, the device and method may be configured to play a Deuces Wild or Joker's Wild game. In some embodiments for Joker's Wild, data is stored in the first data structure 30 representing a standard deck (52 cards) plus at least one Joker for data representing fifty-three cards. In some embodiments only one Joker is included and is "wild" to represent any card in the deck. In some embodiments for Joker's Wild the pay table data stored in the second data structure 32 represents the following winning combinations and awards for a five unit wager:

TABLE US-00005

| | |
|---|---|
| Royal Flush (without Joker) | 5000 |
| 5 of a Kind | 1000 |
| Royal Flush with Joker | 500 |
| Straight Flush | 250 |
| 4 of a Kind | 100 |
| Full House | 35 |
| Flush | 25 |
| Straight | 15 |
| 3 of a Kind | 10 |
| Two pair | 5 |
| Pair of Queens or Better | 5 |

In some embodiments, the processor 15 is programmed to order re-shuffling (reconfiguration and reconstitution) of the deck data upon the first of: (1) where the count the hands played as tracked by the counter 42 is four hands (2) after a hand is played including the Joker, or (3) player commanded re-shuffling.

Blackjack/Baccarat

Figure 4:
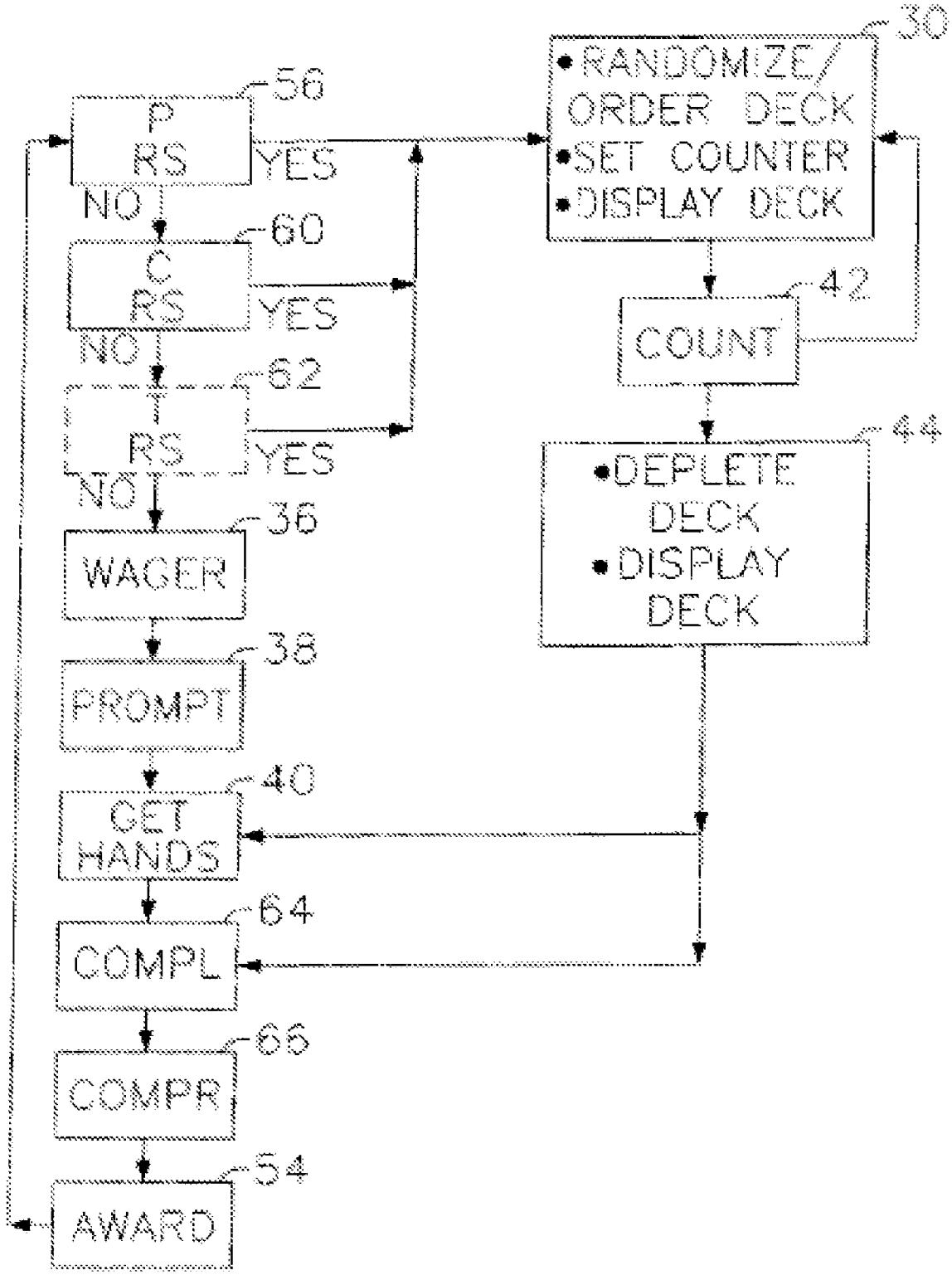
FIG. 4 illustrates a flowchart for a game of Blackjack or Baccarat.
Figure 5:
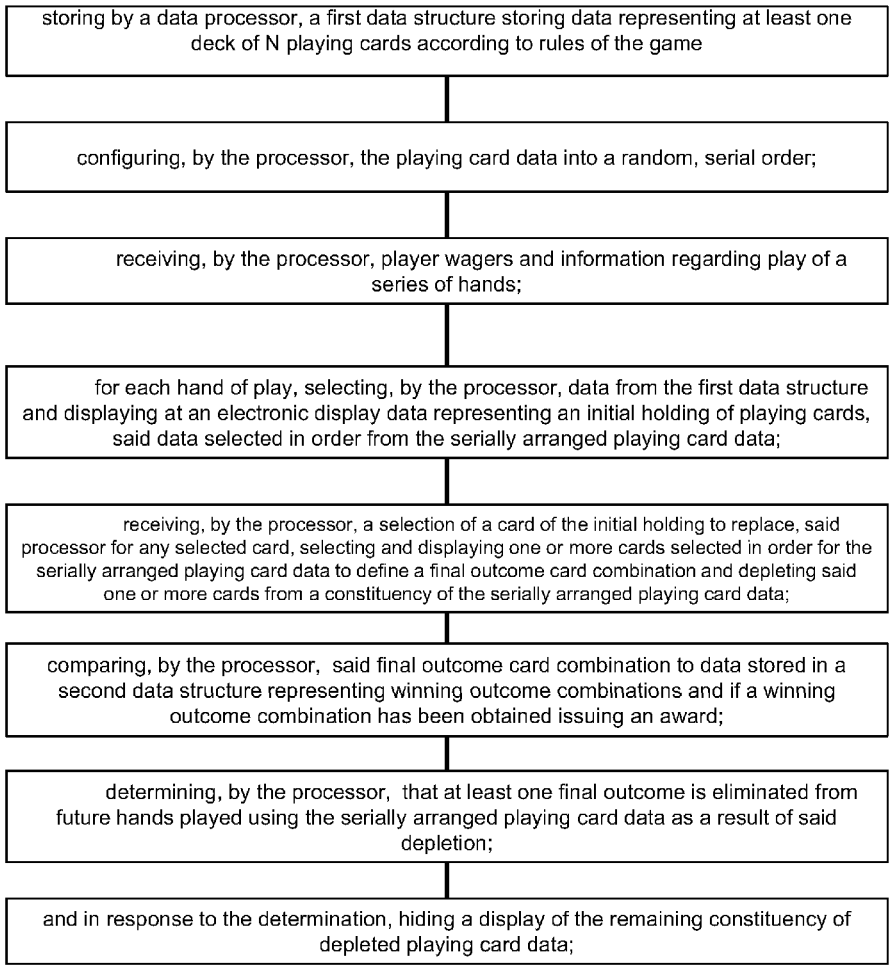
FIG. 5 illustrates an example method that may be performed in some embodiments.

Turning to the example of FIG. 4, there is shown a diagram for the play of Blackjack or Baccarat according to the present invention. Like elements bear like reference numbers.

In some embodiments, at 36 the player inputs their desired wager to play a hand of Baccarat or Blackjack and at 38 prompts the processor 15 for play. In some embodiments, the processor 15 accesses the first data structure 30 to get the next cards at 40 in order from the random, serially arranged, deck data. In some embodiments for Blackjack, the processor would select and display two cards for a player hand and two cards for a dealer hand; however for the dealer hand, only one card is exposed. Thus, at 44, the deck data is depleted by four cards displayed for the initial holding and the constituency of the remaining deck is displayed at table 34 in some embodiments.

With continuing reference to FIG. 4, the processor 15 also counts at 42 the number of cards (and/or hands of play, if desired) represented by the current hand as well as accounts for the value, and if desired suit, of the cards remaining in the deck data inventory of the first data structure 30 in this example. For Baccarat or Blackjack, suit is not important and hence may not be accounted for in some implementations.

In some embodiments, at 64 the hands are completed by the player standing, splitting, doubling down, taking a hit according to the rules of Blackjack. The player's action may require the selection and display of additional cards for the player hand. In some embodiments, for additional cards requested by the player, at 44 and as described above, the deck data is selected in order from the serially arranged, randomized deck data, cards are counted at 42, at 44 the deck data is depleted and the new deck constituency is displayed. In some embodiments, the dealer's hand at 64 is also completed which may require selecting and displaying additional cards according to the well-known rules of the game. In some embodiments, for any additional cards for the dealer's hand, cards are counted at 42, at 44 the deck data is depleted and the new deck constituency is displayed. It should be recognized that this example is non-limiting and that other elements and/or methods may be used in other embodiments.

In some embodiments, when the player and dealer hands have been completed, at 66 the hands are compared, according to the well known rules of the game to determine if the player has won the hand. If the player has won at 54 the award is issued to the player and if not, the player's wager is lost and is retained.

In some embodiments, after the award or if no award was won, the processor 15 determines at 56 if the player has prompted re-shuffling of the deck data of the first data structure 30. In some embodiments, the player may prompt reconfiguration and reconstitution of the deck data of the first data structure 30 into data representing a shuffled, random, serially ordered full deck by touching shuffle button 58 (FIG. 1). In some embodiments, the processor 15 reconfigures and reconstitutes the deck data of the first data structure 30 into data representing cards N.sub.1 N.sub.52 for the fifty-two card deck. In some embodiments, the display 12 would also be controlled to show the constitution of the deck data at table 34. In some embodiments, the player may command re-shuffling where the deck constitution, for the next hand of play, is not what the player desires, e.g. is completely depleted of Aces thus making a Blackjack impossible for the next hand. It should be recognized that his example is non-limiting and other embodiments may include other elements or methods.

In some embodiments, ff the player does not command re-shuffling, re-shuffling may be commanded based upon the count of the card data which has been displayed or additionally or alternatively, the number of hands which have been played since re-shuffling of the deck. According to some embodiments, where penetration into the deck data or the number of hands of play reaches a predetermine number, the processor 15 commands reconfiguration and reconstitution of the deck data. For example, if the count exceeds 30 cards, e.g. (N.sub.1 N.sub.31), at 60 the deck data is reshuffled before the play of the next hand in some embodiments. Or, in some embodiments, if four hands have been played, re-shuffling may be triggered.

In some embodiments, one or more triggers at 62 may trigger re-shuffling and reconstitution of the deck. For example, where all the Aces have been depleted from the deck (making a Blackjack impossible), re-shuffling may be triggered before the play of the next hand in some embodiments.

In some embodiments, Baccarat is played in the same manner as illustrated in FIG. 4 and described above. The difference is the exposure of all cards and the known draw rules for Baccarat to complete the Player and Banker hands therefore.

The device and method may also be applied to other casino card games such as modified Blackjack, Baccarat or Poker games. Further the method can also be employed in a table game using one or more decks of cards and a card reader to read cards as they are distributed to players.

In some embodiments, when an outcome becomes unavailable due to depletion, a display regarding an inventory/deck data may be hidden. For example, in some embodiments, if all outcomes are available based on the constituency of a deck, a display may show information about the constituency; however, if an outcome becomes unavailable due to depletion, the display may be hidden.

In some embodiments, hiding a information may include removing the information from a display (e.g., from a monitor, form a screen, etc.). In some embodiments, hiding information may include preventing the information from being displayed. In some implementations, such information may be displayed under some circumstances, but may be prevented from display under other circumstances.

In some implementations, the number of outcome eliminated based on depletion may be greater than one. For example, in some implementations, the number may include a number equal to all outcomes that are associated with cards dealt in a prior hand. For example, in some implementations, if a two, a king, an ace, and a ten are dealt in a prior hand, then the number may include all outcomes that include any other those cards (e.g., four kings, a straight with any of the cards, etc.).

In some implementations, this hiding of information may affect play by a player. However, such ply may be affected as a deck reaches an end when it is more likely that depletion will have such an effect. It may become easier for a player to track cards as a deck reaches an end than at the beginning of a deck. In some implementations, a player may be presented with a warning that a display of information is about to be hidden so that the player may begin to keep mental track of card/indicia information.

While certain embodiments of the present invention have been described, it should be understood that these embodiments are subject to many modifications and changes without departing from the spirit and scope of the appended claims.

What is claimed is:

1. An electronic device for playing hands of a card game according to rules thereof utilizing data representing a deck of N playing cards:

a first data structure storing data representing each playing card of said deck;

a processor, said processor configured to randomly arrange said playing card data into a random, serial order representing deck data;

a video display;

an interface configured for a player to make a wager and prompt play of the game;

said processor, in response to prompting, configured to select and display at said display data from said first data structure representing a predetermined number of cards selected in order from said first data structure to define an initial holding;

said processor completing said initial holding according to rules thereof by at least one of (1) replacing at least one card of the initial holding or (2) selecting additional cards, said processor configured to select and display, at said display, data representing each replacement or additional cards selected in order from said first data structure to define a final outcome for the hand of play and to deplete a constituency of said deck data of each replacement or additional cards;

said processor configured to determine that at least one final outcome is eliminated from future rounds of the game played using the deck data as a result of said depletion;

said processor configured, in response to the determination, to hide a display of the remaining constituency of the depleted playing card data;

and said processor configured to determine if said final outcome is a winning or losing outcome and to issue an award for a winning combination.

2. The device of claim 1, in which the at least one winning hand includes a plurality of winning hands.

3. The device of claim 2, in which the plurality of winning hands includes all winning hands associated with values used in a prior game hand.

4. The device of claim 1, in which hiding includes at least one of removing from a display; and preventing from being displayed.

5. A method for playing an electronic Video Poker game utilizing data representing a deck of N playing cards comprising:

storing by a data processor, a first data structure storing data representing at least one deck of N playing cards according to rules of the game configuring, by the processor, the playing card data into a random, serial order;

receiving, by the processor, player wagers and information regarding play of a series of hands;

for each hand of play, selecting, by the processor, data from the first data structure and displaying at an electronic display data representing an initial holding of playing cards, said data selected in order from the serially arranged playing card data;

receiving, by the processor, a selection of a card of the initial holding to replace, said processor for any selected card, selecting and displaying one or more cards selected in order for the serially arranged playing card data to define a final outcome card combination and depleting said one or more cards from a constituency of the serially arranged playing card data;

comparing, by the processor, said final outcome card combination to data stored in a second data structure representing winning outcome combinations and if a winning outcome combination has been obtained issuing an award;

determining, by the processor, that at least one final outcome is eliminated from future hands played using the serially arranged playing card data as a result of said depletion;

and in response to the determination, hiding a display of the remaining constituency of depleted playing card data.

6. The method of claim 5, in which the at least one winning hand includes a plurality of winning hands.

7. The method of claim 6, in which the plurality of winning hands includes all winning hands associated with values used in a prior game hand.

8. The method of claim 5, in which hiding includes at least one of removing from a display; and preventing from being displayed.

9. An electronic device for playing hands of a Video Poker game utilizing data representing a deck of N playing cards:

a first data structure storing data representing each playing card of said deck;

a processor, said processor configured to randomly arrange said playing card data into a random, serial order representing deck data;

a video display;

an interface configured for a player to make a wager and prompt play of the game;

said processor, in response to prompting, configured to select and display at said display data from said first data structure representing a predetermined number of cards selected in order from said first data structure to define an initial holding;

in response to a player to selecting from said initial holding at least one card to discard, said processor configured to select and display at said display from said first data structure data representing the cards selected in order from said first data structure to replace each discarded card and to define a final outcome for the hand of play and to deplete said deck data of the cards;

said processor configured to compare said outcome to a schedule of winning outcomes stored in a second data structure and to issue an award for a winning combination;

and said processor further configured to determine that at least one final outcome is eliminated from future rounds of the game played using the deck data as a result of said depletion;

in response to the determination, to hide a display of the remaining constituency of the depleted playing card data.

10. The device of claim 9, in which the at least one winning hand includes a plurality of winning hands.

11. The device of claim 10, in which the plurality of winning hands includes all winning hands associated with values used in a prior game hand.

12. The device of claim 9, in which hiding includes at least one of removing from a display; and preventing from being displayed.

13. A method for playing a card game according to rules thereof comprising:

(a) storing by a data processor, having a first data structure storing data representing each playing card of at least one deck of N playing cards used according to the rules of the game;

(b) receiving, by the processor, wagers and information regarding the play of a hand of the game and prompting play;

(c) according to the rules of the game, displaying, by the processor, cards randomly selected by the processor from the data structure to define an outcome for the hand;

(d) assessing, by the processor, the outcome for the hand to determine if the outcome is a winning outcome according to the predetermined rules of the game and if the outcome is a winning outcome issuing an award to the player;

(e) depleting, by the processor, the card data available for selection and display for subsequent selection and display of card data which has been previously selected and displayed;

(f) determining, by the processor, that at least one final outcome is eliminated as a result of said depletion;

and (g) in response to the determination, hiding, by the processor, the display of the remaining constituency of the depleted playing card data.

14. The method of claim 13, in which the at least one winning hand includes a plurality of winning hands.

15. The method of claim 14, in which the plurality of winning hands includes all winning hands associated with values used in a prior game hand.

16. The method of claim 13, in which hiding includes at least one of removing from a display; and preventing from being displayed.

17. A method for playing a card game according to rules thereof comprising:

(a) storing by a data processor, a first data structure storing data representing at least one deck of N playing cards according to the rules of the game, said card data including data for said cards corresponding to value, the suit of Clubs, Diamonds, Hearts and Spades and where a Joker is included in N, data representing said Joker;

(b) receiving, by the processor, player wagers and information regarding play of each of a series of hands of play;

(c) for each hand of play, randomly selecting, by the processor, and displaying, by the processor from said first data structure at an electronic display data representing an initial holding of at least two playing cards and completing the initial holding to a final holding according to rules thereof by at least one of (1) displaying additional cards or (2) replacing selected cards, said processor for any additional or replaced card randomly selecting and displaying card data from said data structure to define said final outcome, card combination and depleting said card data from said data structure;

(d) determining, by the processor that at least one final outcome is eliminated for games played using said data structure as a result of said depletion and in response to the determination, hiding a display of the remaining constituency of the depleted playing card data;

(e) for each hand determining if the players final outcome is a winning or a losing outcome and issuing an award corresponding to a winning outcome; and (f) at one of (i) the selection and display of a predetermined trigger card or (ii) a predetermined depletion of said playing card data, re-constituting the playing card data representing N cards.

18. The method of claim 17, in which the at least one winning hand includes a plurality of winning hands.

19. The method of claim 18, in which the plurality of winning hands includes all winning hands associated with values used in a prior game hand.

20. The method of claim 17, in which hiding includes at least one of removing from a display; and preventing from being displayed.

21. A method for playing a card game according to rules thereof and using an inventory of playing cards including the four suits of Clubs, Diamonds, Hearts and Spades comprising:

storing, by the processor, data representing each playing card;

receiving, by the processor, wagers and information regarding the play of a series of hands of the game, each hand of the series played by a processor selecting and displaying (1) an initial set of cards and (2) additional or replacement set of cards from said inventory to produce a final, concluding, outcome for the hand, excluding from selection and display data for cards which have been selected and displayed;

determining, by the processor, that at least one final outcome is eliminated as a result of said depletion;

in response to the determination, hiding a display of the remaining constituency of the depleted playing card data; and issuing, by the processor, an award to the player for any hand of the series having a predetermined winning final outcome.

22. The method of claim 21, in which the at least one winning hand includes a plurality of winning hands.

23. The method of claim 22, in which the plurality of winning hands includes all winning hands associated with values used in a prior game hand.

24. The method of claim 21, in which hiding includes at least one of removing from a display; and preventing from being displayed.

25. An electronic device for playing card games according to rules thereof and using an inventory of playing cards including the four suits of Clubs, Diamonds, Hearts and Spades comprising:

a first data structure storing data representing each playing card;

a video display;

a processor, said processor configured to input player wagers to play a series of hands of the game;

said processor configured to select and display at said display (1) an initial set of cards and (2) additional or replacement set of cards from said inventory to produce a final, concluding, outcome for the hand;

said processor configured to exclude from selection and display data for cards which have previously been selected and displayed;

said processor configured to determine if said outcome for the hand is a winning final outcome and if so to issue an award to the player; and said processor configured to determine that at least one final outcome is eliminated as a result of said exclusion; and in response to the determination, to hide a display of the remaining constituency of the depleted playing card data.

26. The device of claim 25, in which the at least one winning hand includes a plurality of winning hands.

27. The device of claim 26, in which the plurality of winning hands includes all winning hands associated with values used in a prior game hand.

28. The device of claim 25, in which hiding includes at least one of removing from a display; and preventing from being displayed.

* * * * *